United States Patent [19]

Nims

[11] Patent Number: 4,546,975

[45] Date of Patent: Oct. 15, 1985

[54] METHOD OF INCREASING BASKETBALL SHOOTING ACCURACY AND AWARENESS

[76] Inventor: Dean L. Nims, 680-59th St., Des Moines, Iowa 50312

[21] Appl. No.: 356,485

[22] Filed: Mar. 9, 1982

Related U.S. Application Data

[62] Division of Ser. No. 90,680, Nov. 2, 1979, Pat. No. 4,345,759.

[51] Int. Cl.[4] ..... A63B 41/00

[52] U.S. Cl. ..... 273/65 R; 273/1.5 A

[58] Field of Search ..... 40/327; 273/65 E, 65 R, 273/1.5 R, 1.5 A; D21/204

[56] References Cited

U.S. PATENT DOCUMENTS

| | | | |
|---|---|---|---|
| 1,436,028 | 11/1922 | Flemming | 40/327 |
| 1,646,347 | 10/1927 | Collette | 273/65 E |
| 3,863,923 | 2/1975 | Anderson | 40/327 X |
| 4,170,352 | 10/1979 | Vcala | 273/29 A |
| 4,345,759 | 8/1982 | Nims | 273/65 EG |

OTHER PUBLICATIONS

"The Sporting Goods Dealer", Feb. 1974, p. 63.

*Primary Examiner*—George J. Marlo
*Attorney, Agent, or Firm*—Zarley, McKee, Thomte, Voorhees & Sease

[57] ABSTRACT

A ball used in sports that is normally propelled to a target includes markings for sighting of the ball to the target by aligning the markings on the ball with the intended line of travel and then focusing on the markings as the ball travels to the target and observing the markings to determine the uniformity of ball rotation. Markings on the ball also serve to make it possible to note the number of revolutions the ball makes in traveling to the target, thereby increasing the sportsman's awareness, concentration and accuracy. Specific indicia markings are disclosed for golf balls and basketballs as examples.

1 Claim, 19 Drawing Figures

METHOD OF INCREASING BASKETBALL SHOOTING ACCURACY AND AWARENESS

This is a division of application Ser. No. 090,680, filed Nov. 2, 1979, now U.S. Pat. No. 4,345,759.

BACKGROUND OF THE INVENTION

Most instruction in most sports such as golf, tennis and basketball, deals with the mechanical aspects of those games. It is believed, however, that the mental part of the game is, in most instances, more important and usually neglected. To perform at a high level in any sport, it is necessary to have relaxed concentration with maximum awareness. In those sports in which a ball is used awareness should be most directly related to the ball at most times including prior to the time the player is called upon to act upon the ball, during preparation for acting upon the ball, and when the player actually actively plays the ball followed by continued observation of the ball thereafter to determine the consequences of his play of the ball.

Accordingly, conventional balls in all sports ordinarily do not have distinctive markings on which the player can focus his attention to maximize his awareness as to two key characteristics of the ball as it is being played. The ball when being launched to a target, should preferably rotate uniformly for maximum accuracy; otherwise as in golf, when the ball is not hit squarely, it will roll off line and the ball will not rotate uniformly. It is, for example in golf, difficult to be aware of this condition since the ordinary golf ball does not carry any markings which can be observed. Accordingly, it is apparent that there is a direct relationship between the uniformity of roll of a golf ball on the green and the success of the putt. Another example in golf is the number of rotations the ball makes in going a given distance is usually thought to be many more than actually is the case; but there again, no markings are provided on golf balls which give the golfer any indication of what actually is happening when the ball is putted on a putting green. The same is true in basketball and other sports.

Accordingly, it is desired that all sports balls and particularly those that can be oriented before being played, be provided with appropriate markings to indicate uniformity of rotation and the number of revolutions the ball makes when being played, and additionally provide means for sighting the ball to the target while also providing a point of focus for the player to maximize his concentration, awareness and accuracy of play.

SUMMARY OF THE DISCLOSURE

Markings are provided on the ball to indicate uniformity of the ball's rotation and the number of revolutions the ball makes while providing a sighting means to the target when setting up to play the ball and additionally a point on which the player's attention may be focused preparatory to playing the ball through the actual playing experience, whereby relaxed concentration is obtained and maximum feedback information to the player is provided which maximizes his awareness when repeating the same or similar activity. Specifically, the uniformity of ball rotation is accomplished through the marking giving the appearance of a 360° line around the circumference of the ball and this may be accomplished by a variety of different continuous or broken marks on the ball which appear as one continuous mark when the ball is rotated. The ball is oriented with the marking in a vertical plane on the line of travel to the target and if the marking remains steady when the ball is played, rather than moving from one side to the other of the vertical plane, it is confirmed that the ball is rotating uniformly.

The number of revolutions a ball makes when being played is indicated by a marking on the ball which extends transversely of the line on which the ball travels to the target, and thus appears to the player once for each revolution, or twice if a marking is used that extends 360° around the ball. Preferably a marking is used that appears only on one side of the ball and thus has a length that is no greater than 180°. This marking may take any number of different shapes or vary in size but a single straight line on the circumference of the ball may be sufficiently noticeable to be effective. In the case of a basketball, a panel of the conventional multi-panel design may be made a solid color contrasting with the color of the remaining panels of the basketball and thus each time the ball revolves, the contrasting colored panel will appear to the player and indicate to him accurately the number of ball rotations as compared to a conventional basketball having multiple panels which give the illusion of the ball rotating many more times than is actually the case, and thus distorting the player's awareness of the ball's characteristics when played.

Relaxed concentration can be obtained through use of these markings since focusing on these markings occupies the mind and frees it of inhibiting thoughts which cause tension and restrict the player's body performance. The markings give the player a point of focus prior to playing the ball to the time the ball reaches its target, which may be the hole on a putting green or the basket on a basketball court or the pins on a bowling alley.

The markings also provide one of the sights taken with the target itself on which alignment of the ball can be made prior to playing it. In the case of golf, the straight marking is placed directly over the intended line to the target and then the putter is placed squarely behind the ball normal to the line and if the ball is then struck squarely, it will predictably roll along the intended line as well as roll uniformly giving the appearance of a straight line on the ball as it rolls all the way to the target. Conversely, if the ball is struck at an angle to the line on the ball, rather than normal to the line, the ball will move off of the intended roll line and the ball will roll non-uniformly with the line appearing irregularly one side or the other of a vertical plane coincident with the intended line of roll.

The ball having a marking on it when arranged transversely to the intended roll line will give the player an indirect sighting means by virtue of the fact that the intended line of roll should be normal to the transversely extending line on the ball and the club head should strike the ball in a parallel relationship to the line for the club head to strike the ball squarely. When the ball is struck, the line will appear to the player each time the ball revolves, and thus give an accurate indication as to how many times the ball has to turn over to reach the hole. This awareness will give the player confidence in the fact that he knows more accurately now how hard the ball has to be hit since he probably will not have to hit it as hard as he once thought since the ball probably is not as many ball revolutions away from the hole as he had thought. Again, relaxed concentration is afforded through providing a point of focus for the eye and mind.

One ball with one marking can be used as desired for determining uniformity or roll or noting body revolutions as for example, a ball having a straight line extending 180° along its periphery can be positioned in a line on the intended roll line in a plane coincident with the roll line to give an indication of uniform roll or alternatively, can be turned 90° to a position with the line extending transversely thereof to give an indication of the number of revolutions. It has been found that a short marking or uniformly spaced markings around the ball give the appearance of a solid line completely around the ball, once the ball begins rotating. Other indicia on the ball can also give a line appearance such as solid colored ball halves in contrasting colors. Preferably, the line should be as narrow as possible and yet still distinguishable since a fine line is more accurate than a thick or wide line in indicating a deviation in a uniform roll, just as a more accurate sighting may be accomplished on a firearm when the points in the sighting are sharply defined as in a hairline telescopic sight.

While the preferred embodiment is a fine line sharply contrasted in color to the color of the ball, thereby making it more distinctive and noticeable, a line appearance can be provided by coloring the opposite half sections of a ball in contrasting colors, thereby forming a 360° line around the ball at the interface of the two ball half sections. A third color forming the line between the contrasting half section colors can add further distinctiveness to the line on the ball.

The ball rotations are more easily discerned by a larger marking on the ball, and thus in the case of a basketball, a single panel of a multi-paneled ball is easily noted during each revolution of the ball. The alternate embodiments are shown varying from a line extending either 180° or 360° around the ball or other designs, such as a star. The ball may also have contrasting colors on opposite half sections, such that during each revolution two contrasting colors will be seen when the ball is rotated about an axis in the plane of the interface between the two half sections.

DESCRIPTION OF THE PREFERRED EMBODIMENT

Figure 1:
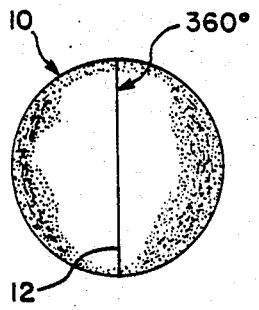
FIG. 1 is a view of a golf ball having a single 360° line about the circumference of the ball.
Figure 3:
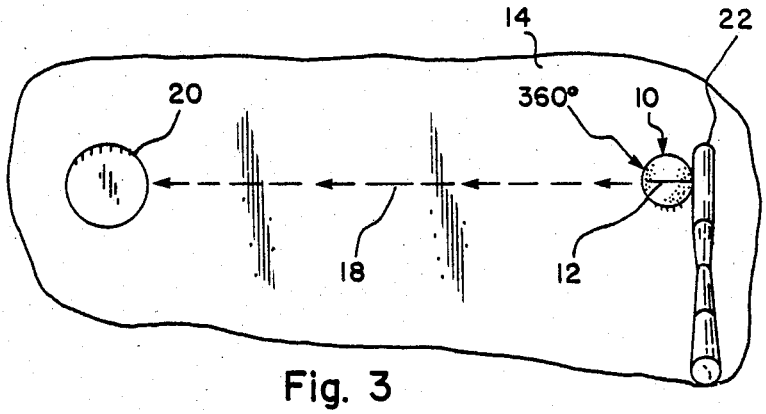
FIG. 3 is a view similar to FIG. 2 showing the putter making contact with the ball squarely normal to the line on the ball.
Figure 2:
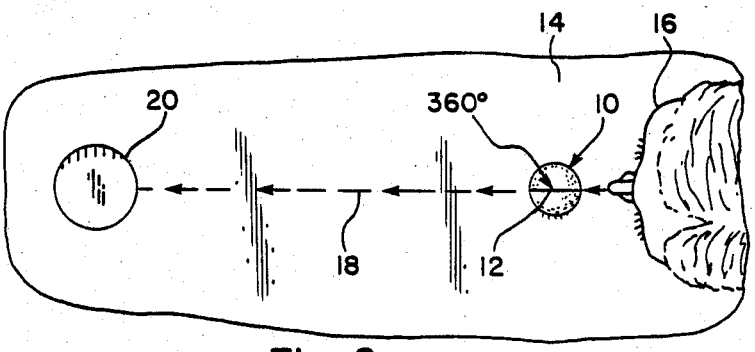
FIG. 2 is a top plan view of the ball on a golf green being set up and sighted to the hole by the player.

The golf ball of FIG. 1 is referred to generally by the reference numeral 10 and includes the marking 12 of this invention. The ball 10 is conventional with a white exterior surface and the line 12 extends 360° around the ball and is of a contrasting color such as black. As seen in FIG. 2, the ball 10 is placed on the putting green 14 and the golfer 16 then positions the ball with the line 12 on the intended putting line 18 to the hole 20. Standing behind the ball as seen in FIG. 2 allows the fine sighting along the ball line 12, putting line 18 to the hole 20. Small adjustments to the ball provide for a very precise alignment. Next, as seen in FIG. 3, the putter 22 is placed behind the ball 10 in a plane normal to the line 12 and then the ball is struck by the putter as shown. The ball should rotate uniformly and the line 12 should appear steady and appear in the vertical plane as the ball moves to the hole 20. If the ball has been hit off of the center or the line 12, then the ball will not rotate uniformly and the line 12 will not appear as a straight continuous line but will move to one side or the other of a vertical plane through the ball and give immediate data to the golfer that he has not hit the ball squarely and presumably the ball will not follow the intended line 18 to the hole. The line 12 on the ball also functions as a point of focus for the eyes to quiet the mind to provide relaxed concentration during the set-up and execution of the stroke.

Figure 4:
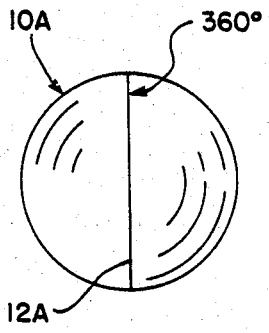
FIG. 4 is a view similar to FIG. 1, but showing a line having a narrower width than that of the line in FIG. 1.

In FIG. 4, a golf ball 10 having a line 12 is shown wherein the line is narrower than line 12 in FIG. 1. Preferably the line should be as narrow as possible, but yet distinctively observable during play.

Figure 5:
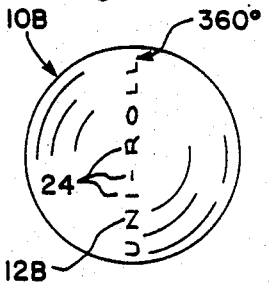
FIG. 5 is a view similar to FIGS. 1 and 4, but showing a series of letters forming the line about the ball.

In FIG. 5, line **12*b* is formed from a series of letters 24 which spell out the word "Uni-Roll" and suggest the use of tradenames or trademarks on the ball, tending to form the line 12*b***.

Figure 6:
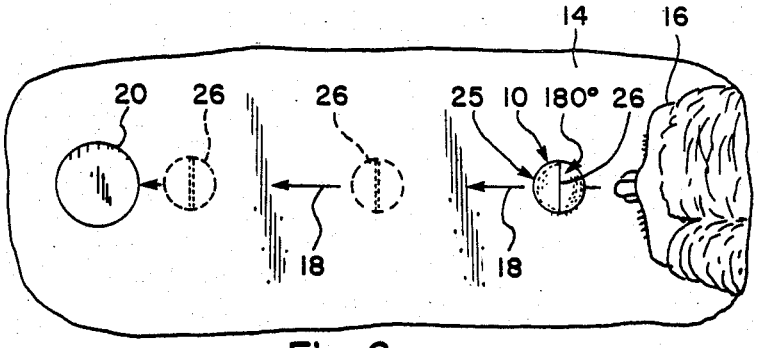
FIG. 6 is a view similar to FIGS. 2 and 3, illustrating the number of ball revolutions for the distance putted.

In FIG. 6, a ball 25 is shown having a 180° line 26 arranged transversely of the putting line 18 to indicate to the golfer 16 the ball rotations required to reach the hole 20 as indicated by the dash line positions which appear at the end of each ball rotation. Most golfers do not have awareness as to the number of ball rotations required for a given putt and thus cannot accurately determine the correct stroke for the putting distance involved. Observing the line 26 as it appears to the putter 16 during each revolution gives the golfer a much greater awareness of what is happening during the putting of a ball 25. In this instance, the putter is aligned behind the ball parallel to the line 26 and thus functions as a further sighting device for aligning the ball with the putting line 18. When using either the balls 10 or 25 once the sighting of the ball to the hole along the line on the ball has occurred, the golfer may relax and be confident that he now need only hit the ball squarely to have a successful putt. The focusing of the eyes on the line on the ball as indicated allows for quieting the mind and relaxing the body muscles to allow them to perform the putting task.

Figure 7:
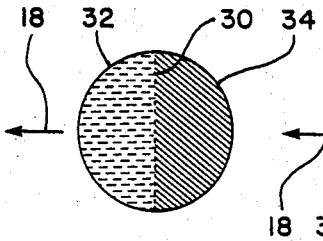
FIG. 7 is a view of a golf ball having contrastingly colored half sections forming a line at the interface thereof.
Figure 8:
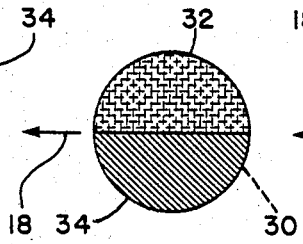
FIG. 8 is a view similar to FIG. 7 but showing the ball rotated 90° with the line on the interface of the half sections parallel to the putting line.

In FIGS. 7 and 8, a 360° line 30 has been formed by the interface of two contrastingly colored half sections 32 and 34. Added emphasis to the line can be provided by making the line a further color such as black with the half sections being in green and yellow. The ball as illustrated in FIG. 7 is positioned on the putting line 18 with the line 30 on the ball being transverse to the putting line for indicating the ball revolutions. In FIG. 8, the line 30 on the ball is arranged in a plane coincident with the putting line 18 as illustrated in FIGS. 2 and 3.

Figure 9:
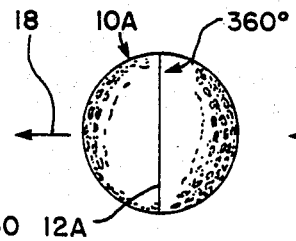
FIG. 9 is a view of a golf ball with a 360° line around it positioned transversely of the putting line.

In FIG. 9 the line 12*a* of FIG. 4 of the golf ball 10*a* is arranged transversely of the putting line 18, and having 360° will appear to the golfer twice for each ball revolution. This ball may be used for indicating both uniformity of roll and ball revolutions, as well as sighting depending on how it is used.

Figure 10:
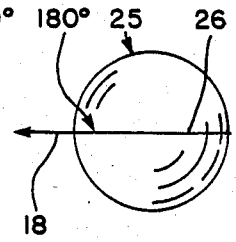
FIG. 10 is a view similar to FIG. 9 but showing a 180° line on a golf ball in the plane of the putting line.

The ball 25 (shown in FIG. 6) is shown in FIG. 10 arranged with the line 26 of 180° positioned on the putting line 18 and when putted will appear as a solid continuous line and thus this ball can be used also to indicate uniformity of ball rotation as well as ball revolutions.

Figure 11:
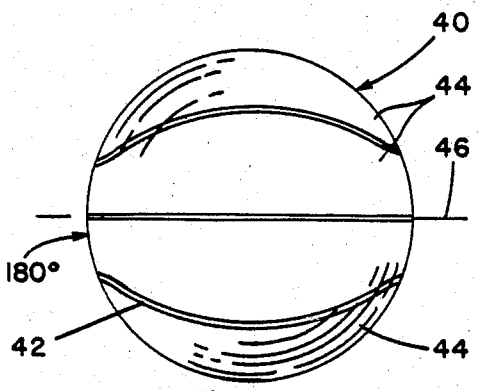
FIG. 11 is a view of a basketball having one of its panels colored in a contrasting color to the remainder of the ball for noting ball rotations.

The basketball 40 of FIG. 11 is of a conventional design and includes one colored panel 42 of a plurality of non-colored panels 44, thereby providing a noticeable marking on the ball which will appear to the shooter once each revolution of the ball as it is being shot or passed. The panel 42 extends 180° between the opposite ends of the ball's axis of rotation 46. Since the basketball moves a further distance from the shooter, the panel 42 needs to occupy a larger area than a 180° line on a golf ball for indicating ball revolutions.

Figure 12:
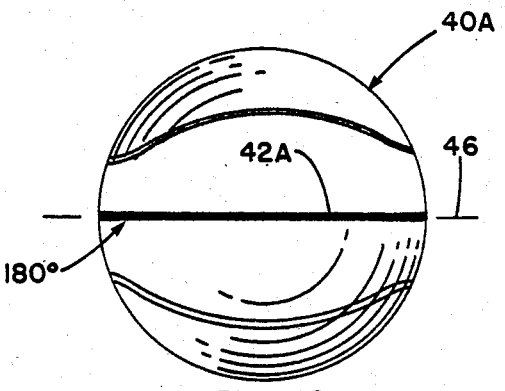
FIG. 12 is a view similar to FIG. 11, but showing a band or bar for noting ball rotations.

The ball 40*a* of FIG. 12 in certain instances may be appropriate and includes a single band or bar 42*a* in lieu of the colored panel 42 of the ball in FIG. 11. The bar 42*a* extends also 180° between the opposite ends of the ball's axis or rotation 46.

Figure 17:
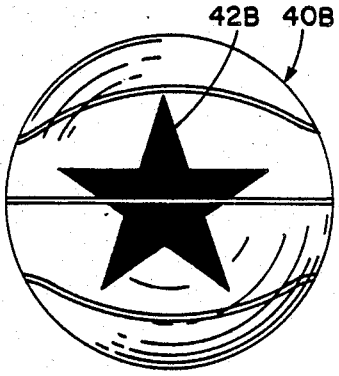
FIG. 17 is a view similar to FIGS. 11 and 12 wherein the marking for counting or noting ball rotations is a star on one side thereof.

In FIG. 17 a star shaped marking 42*b* is placed on one side of the ball 40*b* and is observed by the shooter once each revolution of the ball. This star design would be of any contrasting color to that of the conventional ball which preferably is of a uniform color throughout.

Figure 18:
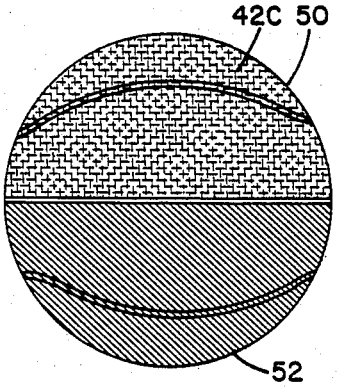
FIG. 18 is a view similar to FIGS. 11, 12 and 17 wherein the ball includes half sections colored in contrasting colors for indicating ball rotations.
Figure 19:
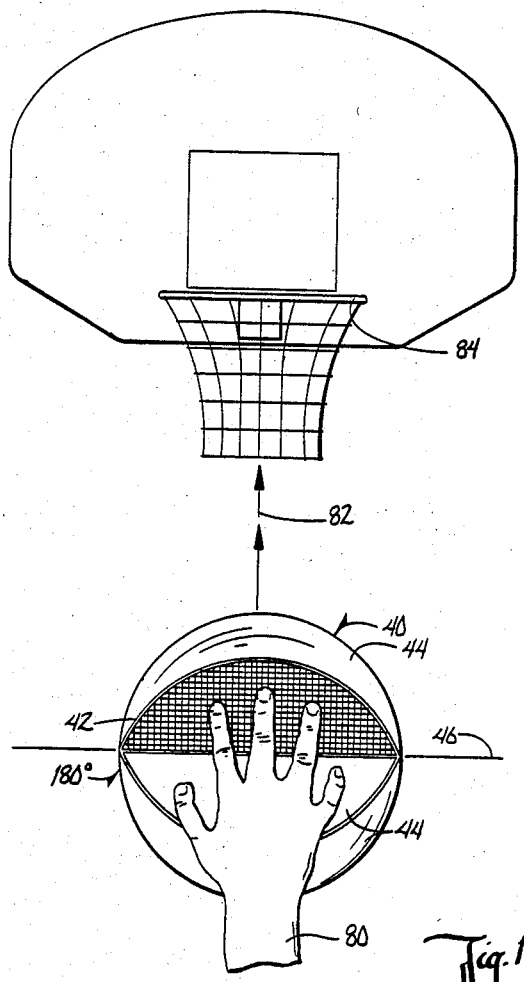
FIG. 19 is a view similar to FIG. 16 but showing the ball of FIG. 11 preparatory to being shot to the basket.

In FIG. 18 a ball 42*c* has half sections 50 and 52 which are colored in contrasting yellow and green colors and thus each revolution of the ball will present to the shooter two different colors to indicate ball revolutions.

Figure 13:
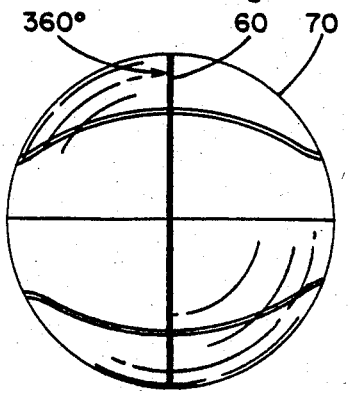
FIG. 13 is a view of a basketball having a 360° line extending around the ball's periphery for noting uniformity of rotation.
Figure 14:
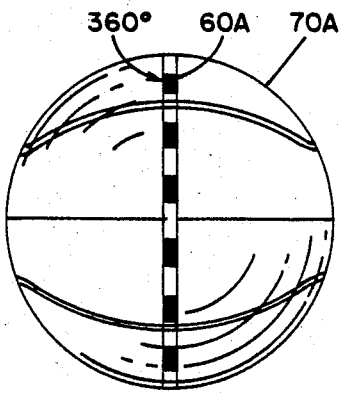
FIG. 14 is a view similar to FIG. 13, but showing the line formed of a series of spaced apart markings.
Figure 15:
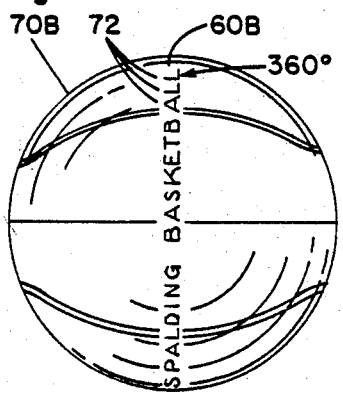
FIG. 15 is a view similar to FIG. 14 with the line around the ball formed from a series of letters which spell out wording on the ball.

In FIGS. 13–16, basketballs are shown that have a single line 360° around the periphery of the basketball for indicating uniformity of rotation and sighting preparatory to shooting or passing the ball. In FIG. 13 a line 60 is provided on the ball 70 while in FIG. 14, a broken line 60*a* functions as a continuous line when the ball 70*a* is rotated. The lettering 72 on the ball 70*b* defines the line 60*b* which extends the full 360° around the ball.

Figure 16:
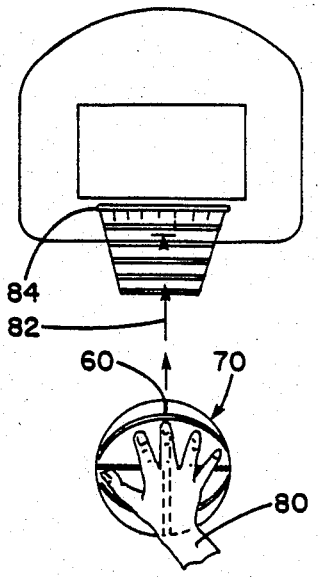
FIG. 16 is a perspective view of the basketball preparatory to being shot to the basket with the line on the ball positioned on the line to the basket.

In FIG. 16, the ball 70 is shown in the shooter's hand 80 positioned on the intended line of flight 82 extending to the basket 84. If the ball 70 is launched with the propelling force applied by the hand 80 being directed to the center of the ball on the line 60, the ball should rotate uniformly all the way to the basket 84. It is seen that the line 60 not only provides for sighting to the basket 84, but presents a point or line for the eyes to focus and concentrate upon during the entire shot. It is recommended that the eyes be focused on the line 60 throughout the entire shot rather than the basket 84 as is conventional with many basketball players. The shooter should focus on the basket before shooting to acquire an awareness of the basket and its distance away, and then concentration should be on the ball and the marking 60 all the way to the basket. Again, this will quiet the mind and give relaxed concentration while at the same time receiving feedback from the ball as it moves to its target, such that the body can make any corrections noted as being necessary when making subsequent shots.

It is contemplated that the marking indicia shown on the golf balls and basketballs is only illustrative of how this indicia may be used on other balls which may be oriented and propelled to a target, thereby giving the person all the advantages that the golfer or basketball player will receive from using the balls disclosed herein.

I claim:

1. A method of shooting a basketball to a basket for increasing ball awareness and shooting accuracy by noting the number of ball revolutions, the basketball being multi-paneled with all panels extending substantially 180° around the periphery of the ball and all panels but one being of the same color and said one panel being of a different single color throughout its extent contrasting in color to said same color, said method comprising, orienting the basketball in the shooter's hands with said one panel of contrasting color to that of the other panels facing the shooter, said one panel extending substantially 180° around the periphery of the ball and having a substantial dimension parallel to the axis of intended ball rotation and being only on one side of the basketball and occupying a small area of the total basketball peripheral area to provide substantial contrast with the remainder of the ball for easy focusing on said one panel as the ball rotates when being shot, focusing the shooter's eyes on said one panel, and shooting the ball to the basket while maintaining the eyes on said one panel continuously until the ball reaches the basket and noting the number of ball revolutions during the ball's travel to the basket.

* * * * *